US005941526A

United States Patent [19]

Martens et al.

[11] Patent Number: 5,941,526

[45] Date of Patent: Aug. 24, 1999

[54] METHOD OF PLAYING AN EDUCATIONAL GAME

[76] Inventors: Dudley Martens, 3961 McClellan Dr.; Daniel H. Burke, Hill Brook Way, Apt. 15, both of Pensacola, Fla. 32503

[21] Appl. No.: 08/935,178

[22] Filed: Sep. 22, 1997

[51] Int. Cl.[6] ..... A63F 3/00

[52] U.S. Cl. ..... 273/249; 273/138.1; 273/269; 273/290

[58] Field of Search ..... 273/299, 138.1, 273/251–254, 269, 290

[56] References Cited

U.S. PATENT DOCUMENTS

| | | | |
|---|---|---|---|
| 1,884,500 | 10/1932 | Anderson | 340/286.14 |
| 2,508,273 | 5/1950 | Krick | 434/217 |
| 2,532,061 | 11/1950 | Glick | 434/217 |
| 2,683,946 | 7/1954 | Olson | 40/470 |
| 2,854,765 | 10/1958 | Rickless | 434/217 |
| 4,402,672 | 9/1983 | Lowe, Sr. | 434/217 |
| 4,640,513 | 2/1987 | Montijo | 273/249 |
| 4,781,378 | 11/1988 | Clinnin et al. | 273/269 |
| 4,852,886 | 8/1989 | Zaruba et al. | 273/249 |
| 4,932,666 | 6/1990 | Corle | 273/249 |
| 5,340,113 | 8/1994 | Respicio | 273/249 |

*Primary Examiner*—Benjamin H. Layno
*Attorney, Agent, or Firm*—Joseph N. Breaux

[57] ABSTRACT

An educational game that includes a game board including a counterclockwise oriented sequence of game piece spaces, the sequence beginning with an outer start space and terminating in a center end space, the game piece spaces including penalty indicia spaces, no indicia spaces and safety card select indicia spaces; a number of player positionable game pieces; four two-sided tossing pieces; and a number of safety cards each having a side having a point winning indicia in a corner thereof and educational information printed in the center area thereof. The educational game is played by tossing the four two-sided tossing pieces onto a surface and moving a game piece along the sequence of game piece spaces on the game board according to the result of the toss. Points are accumulated as each player travels from the start space to the center end space, collecting points by drawing safety cards. The first player entering the center end space receives five bonus points. The player with the most points after all the players have entered the center end space is declared the winner. The four two-sided tossing are preferably readily available coins.

1 Claim, 2 Drawing Sheets

METHOD OF PLAYING AN EDUCATIONAL GAME

TECHNICAL FIELD

The present invention relates to educational games and more particularly to an educational board game having a game board including a counterclockwise oriented sequence of game piece spaces beginning with an outer start space and terminating in a center end space, the game piece spaces including penalty indicia spaces and safety card select indicia spaces; a number of player positionable game pieces; four two-sided tossing pieces; and a number of safety cards each having a side having a point winning indicia in a corner thereof and educational information printed in the center area thereof; and wherein the educational board game is played by tossing the four two-sided tossing pieces onto a surface and moving a game piece along the sequence of game piece spaces according to the result of the toss.

BACKGROUND OF THE INVENTION

Games can be used to instruct as well as to entertain. It would be a benefit, therefore, to have a board game that could instruct the players in hurricane safety as well as provide entertainment to the players. Because hurricanes typically strike in coastal regions where a large number of visitors from inland areas congregate, it would be a further benefit to have an educational board game that could be played in restaurants while waiting for food and drinks to be served. It would of course be a further benefit to have such an educational game that included a game board that could be printed onto a paper place mat.

SUMMARY OF THE INVENTION

It is thus an object of the invention to provide an educational game that can instruct the players in hurricane safety as well as provide entertainment to the players.

It is a further object of the invention to provide an educational game that can be played in restaurants while waiting for food and drinks to be served.

It is a still further object of the invention to provide an educational game that includes a game board that can be printed onto a paper place mat.

It is a still further object of the invention to provide an educational game that has a game board including a counterclockwise oriented sequence of game piece spaces, the sequence beginning with an outer start space and terminating in a center end space, the game piece spaces including penalty indicia spaces, no indicia spaces and safety card select indicia spaces; a number of player positionable game pieces; four two-sided tossing pieces; and a number of safety cards each having a side having a point winning indicia in a corner thereof and educational information printed in the center area thereof; and wherein the educational board game is played by tossing the four two-sided tossing pieces onto a surface and moving a game piece along the sequence of game piece spaces according to the result of the toss points are accumulated as each player travels from the start space to the center end space, the first player entering the center end space receiving five bonus points, the player with the most points after all players have entered the center end space is declared the winner.

It is a still further object of the invention to provide an educational game that accomplishes some or all of the above objects.

Accordingly, an educational game is provided. The educational game includes a game board including a counterclockwise oriented sequence of game piece spaces, the sequence beginning with an outer start space and terminating in a center end space, the game piece spaces including penalty indicia spaces, no indicia spaces and safety card select indicia spaces; a number of player positionable game pieces; four two-sided tossing pieces; and a number of safety cards each having a side having a point winning indicia in a corner thereof and educational information printed in the center area thereof. The educational game is played by tossing the four two-sided tossing pieces onto a surface and moving a game piece along the sequence of game piece spaces on the game board according to the result of the toss. Points are accumulated as each player travels from the start space to the center end space, collecting points by drawing safety cards. The first player entering the center end space receives five bonus points. The player with the most points after all the players have entered the center end space is declared the winner. The four two-sided tossing are preferably readily available coins. In a preferred method, the game piece is moved forward one space for each coin landing heads up. If all four coins land tails up, the player must move backward one space.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
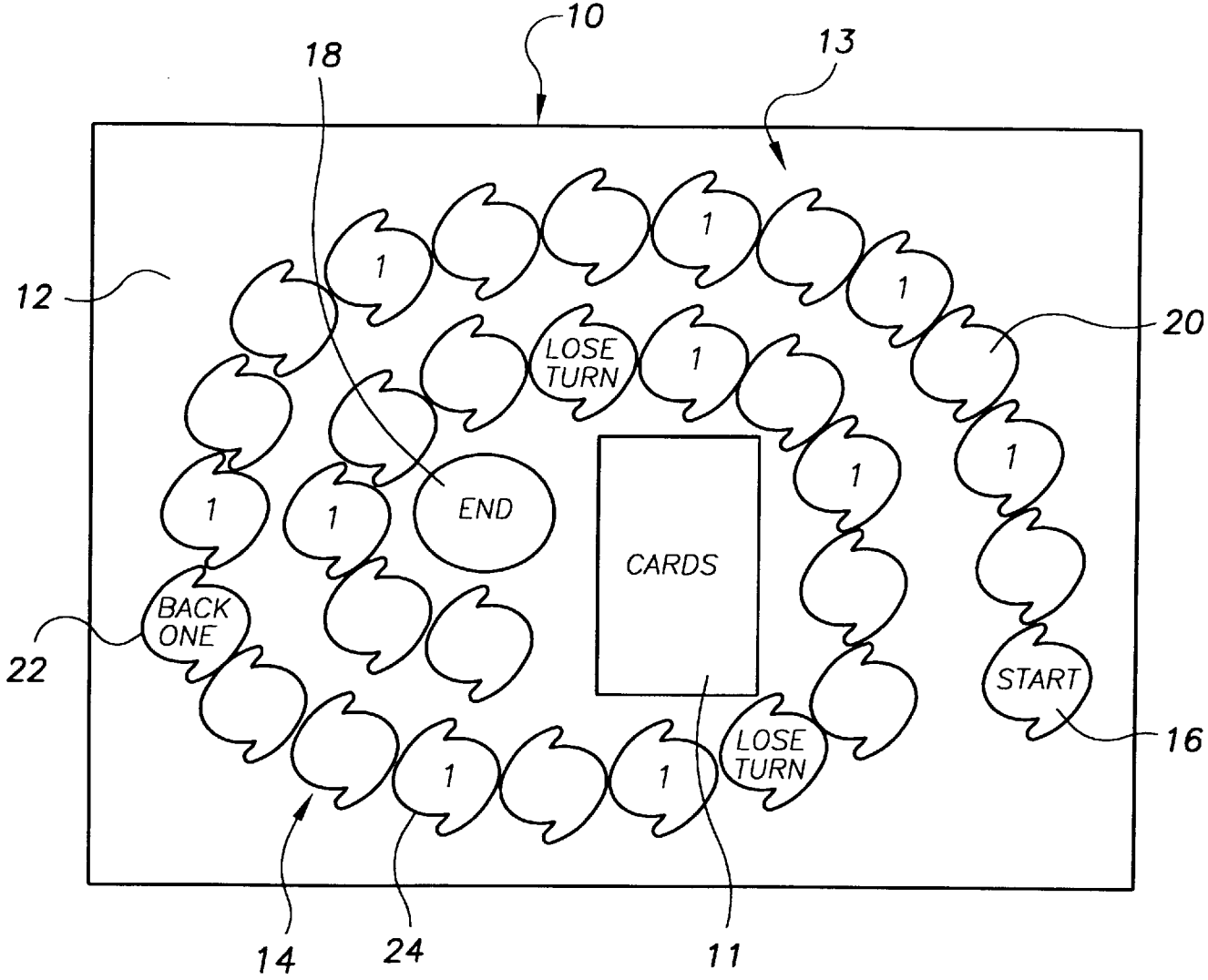
FIG. 1 is a top plan view of an exemplary embodiment of the game board of the educational game of the present invention printed onto a paper place mat showing the counterclockwise oriented game piece spaces, the safety card positioning space, the penalty indicia spaces, the safety card indicia spaces, and the center end space.

FIG. 1 shows an exemplary embodiment of the game board of the educational game of the present invention, generally designated 10, printed onto a conventional paper place mat 13. Game board 10 has a top surface 12 having a safety card positioning space 11 and a sequence of counterclockwise oriented game piece spaces, generally designated 14, that begin with an outer start space 16 and end with a center end space 18. Game piece spaces 14 include plain spaces 20, penalty indicia spaces 22, and safety card indicia spaces 24. During play landing on a penalty indicia space 22 results in the designated penalty, such as losing a turn or moving back one or more spaces, and landing on a safety card indicia space requires the player to draw a safety card from a stack of safety cards positioned on safety card positioning space 11. Landing on a plain space 20 is a safe haven.

Figure 2:
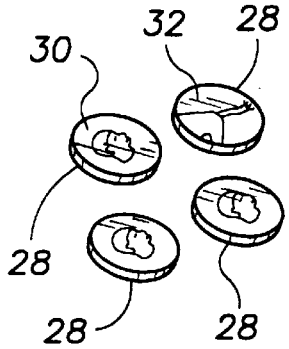
FIG. 2 is a perspective view of the four two-sided tossing pieces.

With reference to FIG. 2, in this embodiment, the safety game includes four stamped metal two-sided tossing pieces 28. Each tossing piece 28 has a head surface 30 and a tail surface 32. Regular coins, such as pennies, can be substituted for tossing pieces 28 when game board 10 is printed on a paper place mat to reduce the cost of supplying the game to patrons in a restaurant.

Figure 3:
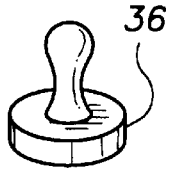
FIG. 3 is a perspective view of an exemplary playing piece.

With reference to FIG. 3, in this embodiment the educational game includes a number of plastic game pieces 36. One game piece 36 is needed for each player. A number of players can of course play with one game piece when teams of players are playing the educational game. Although a number of molded plastic game pieces 36 are provided in this embodiment, any item such as coins, candies, etc., can be used in place of game pieces 36 to indicate a player's position on game board 10 (FIG. 1).

Figure 4:
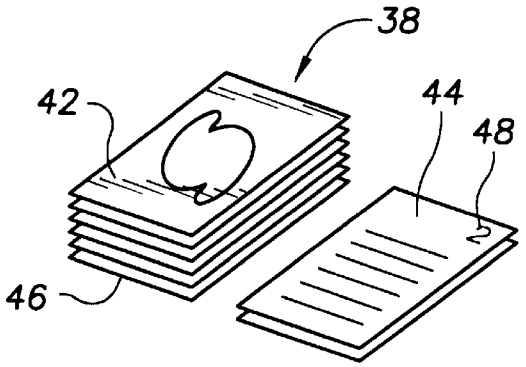
FIG. 4 is a perspective view of a stack of the safety cards with one of the safety cards turned over to show the point winning indicia in a corner thereof and the information printed in the center thereof.

With reference to FIG. 4, the educational game includes a number of safety cards 38 that have an upper surface 42 and an informational surface 44. When placed into a stack 46, safety cards 38 are placed with upper surface 42 facing upward. Each informational surface 44 includes a number indica 48 in a corner of informational surface 44 to indicate the number of points the drawing player is to receive and educational information printed in the center thereof which the player must read aloud to obtain the points.

Figure 5:
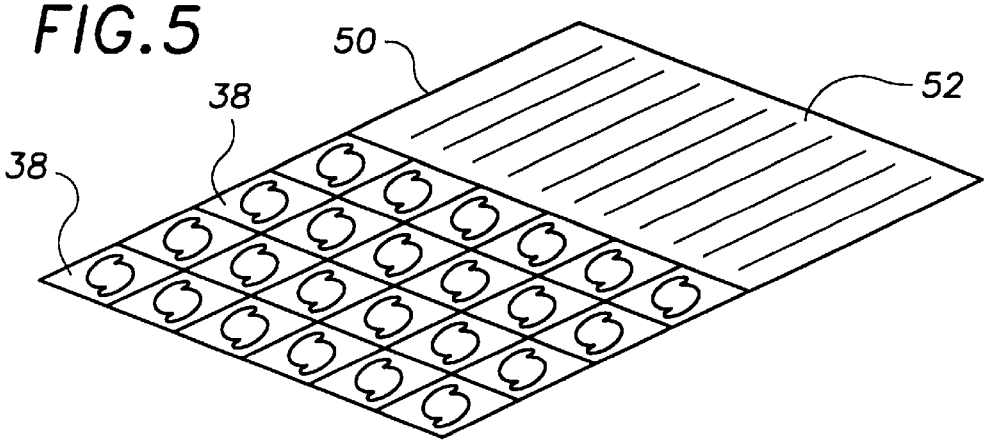
FIG. 5 is a perspective view of the safety cards printed onto a first area of a paper place mat and the game instructions printed onto a second area of the paper place mat.

With reference to FIG. 5, in this embodiment, safety cards 38 are printed onto the front and back surfaces of a paper place mat 50. Place mat 50 also includes an area 52 upon which the game instructions are printed. In this embodiment of the educational game, place mats 13 and place mats 50 are packaged together so that at least one diner receives a place mat 13 and one diner receives a place mat 50 allowing diners in groups of two or more to play the educational game according to the rules previously described.

It can be seen from the preceding description that an educational game has been provided that can instruct the players in hurricane safety as well as provide entertainment to the players; that can be played in restaurants while waiting for food and drinks to be served; that includes a game board that can be printed onto a paper place mat; and that has a game board including a counterclockwise oriented sequence of game piece spaces, the sequence beginning with an outer start space and terminating in a center end space, the game piece spaces including penalty indicia spaces, no indicia spaces and safety card select indicia spaces; a number of player positionable game pieces; four two-sided tossing pieces; and a number of safety cards each having a side having a point winning indicia in a corner thereof and educational information printed in the center area thereof. Additionally, a method of playing an educational board game has been provided wherein the game is played by tossing the four two-sided tossing pieces onto a surface and moving a game piece along the sequence of game piece spaces according to the result of the toss points are accumulated as each player travels from the start space to the center end space, the first player entering the center end space receiving five bonus points, the player with the most points after all players have entered the center end space is declared the winner.

It is noted that the embodiment of the educational game described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A method of playing an educational game comprising the steps of:

providing a stack of first and second place mats stacked in an alternating pattern, said first place mats each having a game board printed thereon including a counterclockwise oriented sequence of game piece spaces, the sequence beginning with an outer start space and terminating in a center end space, the game piece spaces including penalty indicia spaces, no indicia spaces and safety card select indicia spaces, said second place mats each having a number of safety cards printed thereon, each said safety card having having a side having a point winning indicia in a corner thereof and educational information printed in the center area thereof;

selecting a first and a second place mat from said stack;

providing a number of player positionable game pieces;

providing four two-sided tossing pieces, each two-sided tossing piece having a head side and a tail side;

positioning one of the number of player positionable game pieces onto the an outer start space for each player to play;

each player sequentially tossing the four two-sided tossing pieces onto a surface;

each player moving a respective game piece along the sequence of game piece spaces a number of game piece spaces away from the outer start space that corresponds to the number of the four two-sided tossing pieces that land head side up;

each player moving a respective game piece along the sequence of game piece spaces one game piece space toward the outer start space when all four two-sided tossing pieces land tail side up;

each player scoring a number of points corresponding to the total number of point winning indicia of all of the safety cards drawn by that player;

awarding bonus points to the player moving a respective game piece into said center end space first;

declaring as winner after all respective game pieces have entered said center end space the player with the highest score total.

* * * * *